US010329865B1

(12) United States Patent
Baugh

(10) Patent No.: US 10,329,865 B1
(45) Date of Patent: Jun. 25, 2019

(54) INDEPENDENT RAM ACTIVATION FOR A BLOWOUT PREVENTER

(71) Applicant: Benton Frederick Baugh, Houston, TX (US)

(72) Inventor: Benton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 26 days.

(21) Appl. No.: 15/413,586

(22) Filed: Jan. 24, 2017

Related U.S. Application Data

(60) Provisional application No. 62/286,513, filed on Jan. 25, 2016.

(51) Int. Cl.
*E21B 33/06* (2006.01)
*E21B 33/076* (2006.01)

(52) U.S. Cl.
CPC ..... *E21B 33/063* (2013.01); *E21B 33/076* (2013.01)

(58) Field of Classification Search
CPC ..... E21B 33/06; E21B 33/061; E21B 33/064; E21B 33/076; E21B 33/063
See application file for complete search history.

(56) References Cited

U.S. PATENT DOCUMENTS

2017/0107779 A1* 4/2017 Akhare ..... E21B 33/063

* cited by examiner

*Primary Examiner* — James G Sayre
(74) *Attorney, Agent, or Firm* — Phillips Murrah PC; Martin G. Ozinga

(57) ABSTRACT

The present invention is an apparatus, system and method that may provide a power supply for engaging blowout preventer rams to secure a subsea well bore of a subsea drilling system supply which is independent of the conventional control systems, shuttle valves, seals and plumbing of the conventional control system.

1 Claim, 8 Drawing Sheets

INDEPENDENT RAM ACTIVATION FOR A BLOWOUT PREVENTER

CROSS-REFERENCE TO RELATED APPLICATIONS

Priority is claimed from U.S. Provisional Application Ser. No. 62/286,513 filed on Jan. 25, 2016 and incorporated by reference herein.

BACKGROUND OF INVENTION

1. Field of the Invention

In general, the present invention relates to a device, system and method for subsea blowout preventers in oil and gas well operations. More particularly, the present invention provides an improved closing of rams, and specifically, the shear rams on a blowout preventer stack, which is independent of the primary control method.

2. Description of the Prior Art

As known in the art, a blowout preventer is a large, specialized valve or similar mechanical device, usually installed redundantly in stacks, used to seal, control and monitor oil and gas wells. Blowout preventers were developed to cope with extreme erratic pressures and uncontrolled flow, often referred to as a formation kick, emanating from a well reservoir during drilling. Kicks can lead to a potentially catastrophic event known as a blowout. In addition to controlling the downhole pressure occurring in the drilled hole and the flow of oil and gas, blowout preventers are intended to prevent tubing such as drill pipe and well casing, tools and drilling fluid from being blown out of the wellbore when a blowout threatens.

Subsea blowout preventer stacks, conventionally and by legal requirement, have two independent control systems. These are conventionally referred to as the blue system and the yellow system, which mostly provide independent control of the functions on the subsea blowout preventer stack, and specifically, the safety blind shear rams on the blowout preventer stack. These are in fact independent, except that they are not independent on a shuttle valve, the piping between the shuttle valve and the actuating piston and cylinder, and the accumulator system providing the power for actuation. Said another way, the shuttle valves, piping between the shuttle valve and the blowout preventer body, piston, and cylinder represent single points of failure, which when failed, cause a complete loss of control of the blowout preventer stack. The components on the other side of the shuttle valves would require two independent failures to disable a blowout preventer stack.

The shuttle valves are control devices, which have an outlet to a function, two inlets from two control sources, and a shuttle member between the two inlets. When a control signal comes in from one of the control sources, the shuttle is pushed over to block leakage out of the other of the two control sources. The failure of a shuttle valve or piping between the shuttle valve and the blowout preventer itself can destroy the ability of both the control sources to exercise control. For this reason, shuttle valves are mounted as close to the blowout preventer stack as possible to minimize the number of components, which are a single point of failure.

Similarly, the actuating piston and cylinder represent single points of failure. The blowout preventer body itself is a single point of failure, and represents a minimal risk, which cannot be mitigated. Even with an awareness of this risk, a separate system for giving a completely redundant control system has not been available to this date.

Thus, there is a need for an apparatus, process and or system that provides for closing rams independent of the primary control methods. It is desirable to fill these needs with reliable technology that are affordable and attractive to subsea operations with blow out preventers. The above discussed limitations in the prior art is not exhaustive. The current invention provides an inexpensive, time saving, more reliable apparatus, method and system where the prior art fails.

SUMMARY OF THE INVENTION

In view of the foregoing disadvantages inherent in the known types of blowout preventers ram systems now present in the prior art, the present invention provides a new and improved apparatus, system, and method of use that provides better and more reliable performance. As such, the general purpose of the present invention, which will be described subsequently in greater detail, is to provide a new and improved blow out preventer, which has all the advantages of the prior art devices and none or less of the disadvantages.

It is, therefore, contemplated that the present invention is an apparatus, system and method that may provide a power supply for engaging blowout preventer rams to secure a subsea well bore of a subsea drilling system supply, which is independent of the conventional control systems, shuttle valves, seals and plumbing of the conventional control system. It may comprise providing a ram cavity extension, whose inner profile may generally match the inner profile of the ram cavity, providing a secondary piston adapted to sealingly engage the bore of said ram cavity extension and said ram cavity and adapted for sealingly engaging the outer diameter of the piston rod connecting the conventional operating piston and the blowout preventer rams, providing said piston rod is lengthened proximately the width of said ram cavity extension, providing secondary fluid porting on the distal side of said secondary piston from said bore of said subsea drilling system, and providing a secondary fluid supply into said secondary porting to move said secondary piston and blowout preventer rams into an engaged position securing said subsea well bore.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved blow out preventer with an independent ram activation apparatus, system and method for use in subsea operations.

Furthermore, an object of the present invention is to provide a new and improved blow out preventer with an independent ram activation apparatus, system and method, which allows for losing rams, such as but not limited to the shear rams, independently of the primary control.

Another object of the present invention is to provide a new and improved blow out preventer with an independent ram activation apparatus, system and method, which may include and actuate the shear rams without going through the shuttle valve on the blowout preventer.

It is a further object of the present invention to provide a new and improved blow out preventer with an independent ram activation apparatus, system and method, which is of a durable and reliable construction and may be utilized in numerous types of applications.

An even further object of the present invention is to provide a new and improved blow out preventer with an independent ram activation apparatus, system and method, which is susceptible to a low cost of installation and labor, which accordingly is then susceptible to low prices of sale to the consuming industry, thereby making such a system economically available to those in the field.

Still another object of the present invention is to provide a new and improved blow out preventer with an independent ram activation apparatus, system and method, which provides all of the advantages of the prior art while simultaneously overcoming some of the disadvantages normally associated therewith.

Furthermore, an object of the present invention is to provide a new and improved blow out preventer with an independent ram activation apparatus, system and method, which does not depend upon the pistons or piston seals on a blowout preventer stack.

Another object of the present invention is to provide a new and improved blow out preventer with an independent ram activation apparatus, system and method that provides greater closing and shearing forces than can be obtained by the conventional means.

It is a further object of the present invention to provide a new and improved blow out preventer with an independent ram activation apparatus, system and method that provides closing and shearing forces that can be combined with the force from the conventional means to provide a force greater than either of the two individual forces.

Still another object of the present invention is to provide a new and improved blow out preventer with an independent ram activation apparatus, system and method, which may be a kit to retro fit existing subsea blow out preventer stacks and other types of blow out preventers.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
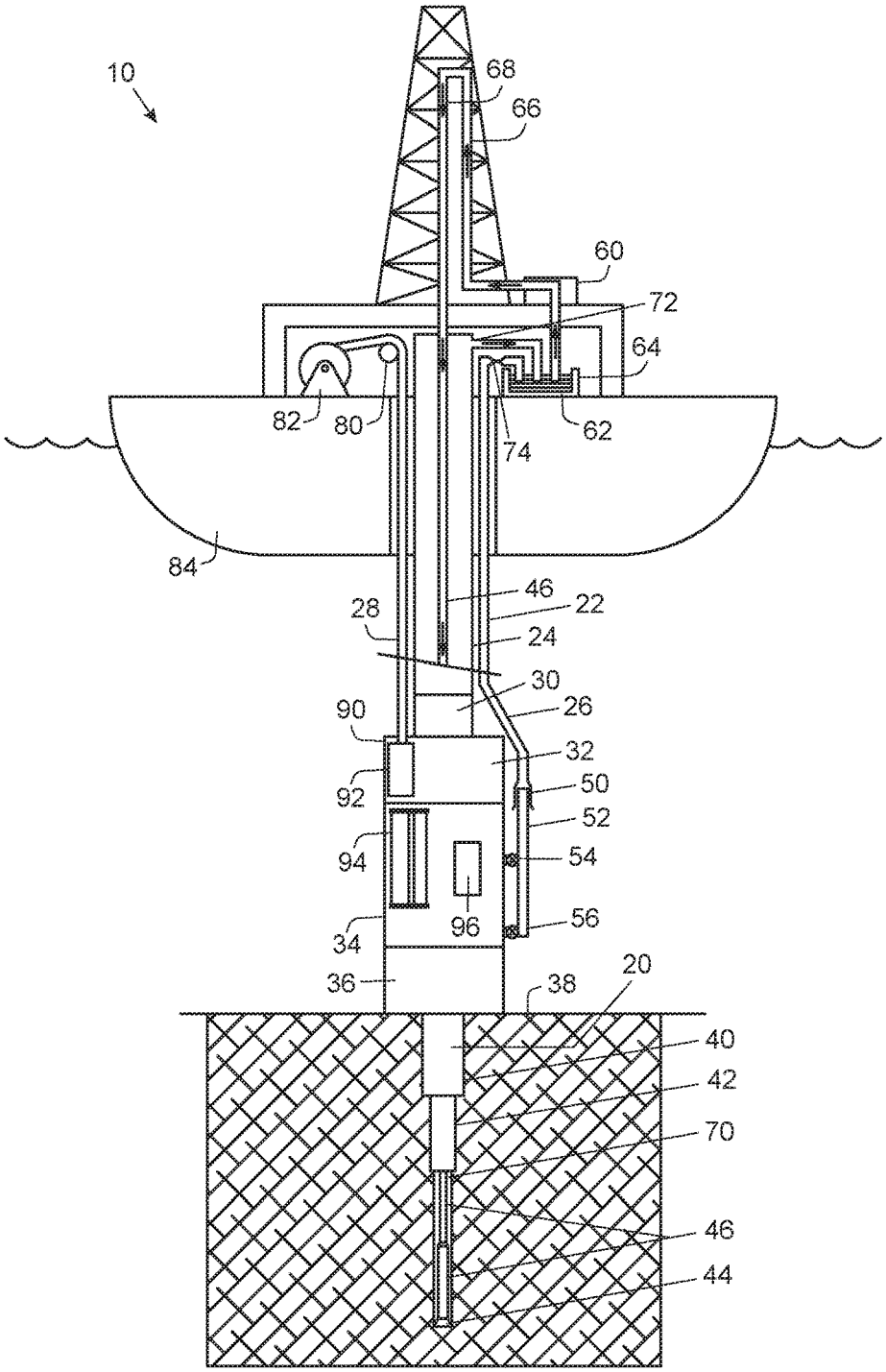
FIG. 1 is generally a view of a system of subsea equipment utilizing the redundant control system in accordance with a preferred embodiment of the invention.

Referring to the illustrations, drawings, and pictures, and to FIG. 1 in particular, reference character 10 generally designates a new and improved independent ram activation for a blowout preventer apparatus, system and method of using same constructed in accordance with the present invention. Invention 10 is generally used in oil and gas well operations such as but not limited to blow out preventers and may be utilized in other operations not associated with oil and gas drilling operations. For purposes of convenience, the reference numeral 10 may generally be utilized for the indication of the invention, portion of the invention, preferred embodiments of the invention and so on. Invention 10 may also include a new and improved blowout preventer apparatus, system and method as well as new and improved blowout preventer activation ram apparatus, system and method. It is also to be understood that invention 10 may not be limited to shear rams, but may be utilized in other types of rams.

Referring now to FIG. 1, a view of a complete system for drilling subsea wells 20 is shown in order to illustrate the utility of the present invention. Drilling riser 22 is shown with a central pipe 24, outside fluid lines or pipe 26, and cable, hose or umbilical 28.

Below the drilling riser 22 is a flex joint 30, lower marine riser package 32, lower blowout preventer stack 34 and wellhead system 36 landed on seafloor 38.

Below the wellhead system 36, it can be seen that a hole was drilled for a first casing string 40, that first casing string 40 was landed and cemented in place, a hole drilled through the first string for a second casing string 42, the second casing string 42 cemented in place, and a hole is being drilled for a third casing string by drill bit 44 on drill string 46.

The lower blowout preventer stack 34 generally comprises a lower hydraulic connector for connecting to the subsea wellhead system 36, usually 4 or 5 ram style blowout preventers, an annular preventer, and an upper mandrel for connection by the connector on the lower marine riser package 32, which are not individually shown but are well known in the art.

Below outside fluid line 26 is a choke and kill (C&K) connector 50 and a pipe 52, which is generally illustrative of a choke or kill line. Pipe 52 goes down to valves 54 and 56, which provide flow to or from the central bore of the blowout preventer stack as may be appropriate from time to time. Typically, a kill line will enter the bore of the blowout preventer below the lowest ram and has the general function of pumping heavy fluid to the well to overburden the pressure in the bore or to "kill" the pressure. The general implication of this is that the heavier mud cannot be circulated into the well bore, but rather must be forced into the formations. A choke line will typically enter the well bore above the lowest ram and is generally intended to allow circulation in order to circulate heavier mud into the well to regain pressure control of the well. Normal circulation is down the drill string 46, through the drill bit 44.

In normal drilling circulation, mud pumps 60 take drilling mud 62 from mud tank 64. The drilling mud 62 will be pumped up a standpipe 66 and down upper end 68 of the drill string 46. It will be pumped down the drill string 46, out the drill bit 44, and return up annular area 70 between the outside of the drill string 46 and the bore of the hole being drilled, up the bore of the second casing string 42, through the subsea wellhead system 36, the lower blowout preventer stack 34, the lower marine riser package 32, up the drilling riser 22, out a bell nipple 72 and back into the mud tank 64.

During situations in which an abnormally high pressure from the formation has entered the well bore, the thin walled central pipe 24 is typically not able to withstand the pressures involved. Rather than making the wall thickness of the relatively large bore drilling riser thick enough to withstand the pressure, the flow is diverted to a choke line or outside fluid line 26. It is more economical to have a relatively thick wall in a small pipe to withstand the higher pressures than to have the proportionately thick wall in the larger riser pipe.

When higher pressures are to be contained, one of the annular or ram blowout preventers are closed around the drill pipe and the flow coming up the annular area 70 around the drill pipe is diverted out through choke valve 54 into the pipe 52. The flow passes up through C&K connector 50, up pipe 26, which is attached to the outer diameter of the central pipe 24, through choking means illustrated at 74, and back into the mud tank 64.

On the opposite side of the drilling riser 22 is shown cable, hose or umbilical 28 coming across a sheave 80 from a reel 82 on vessel 84. The umbilical 28 is shown characteristically entering top 90 of the lower marine riser package 32. These cables 28 typically carry hydraulic, electrical, multiplex electrical, or fiber optic signals. Typically, there are at least two of these systems for redundancy, which are characteristically painted yellow and blue.

If reel 82 is a control umbilical, as the umbilical 28 enters the top 90 of the lower marine riser package 32, it typically enters a control pod 92 to deliver their control signals.

If reel 82 is a hydraulic reel, hydraulic supply is delivered to one or more primary hydraulic accumulators 94 located on the lower marine riser package 32 or the lower blowout preventer stack 34 to store hydraulic fluid under pressure until needed.

Secondary power supply storage 96 is shown as separate fluid supply, which can be used to power the components of this invention without depending on the primary hydraulic primary accumulators 94. Secondary supply storage can be conventional accumulators similar to those of primary hydraulic accumulators 94 or potentially other sources such as "pyro-accumulators," which depend upon a chemical explosion to rapidly generate a high pressure source.

Figure 2:
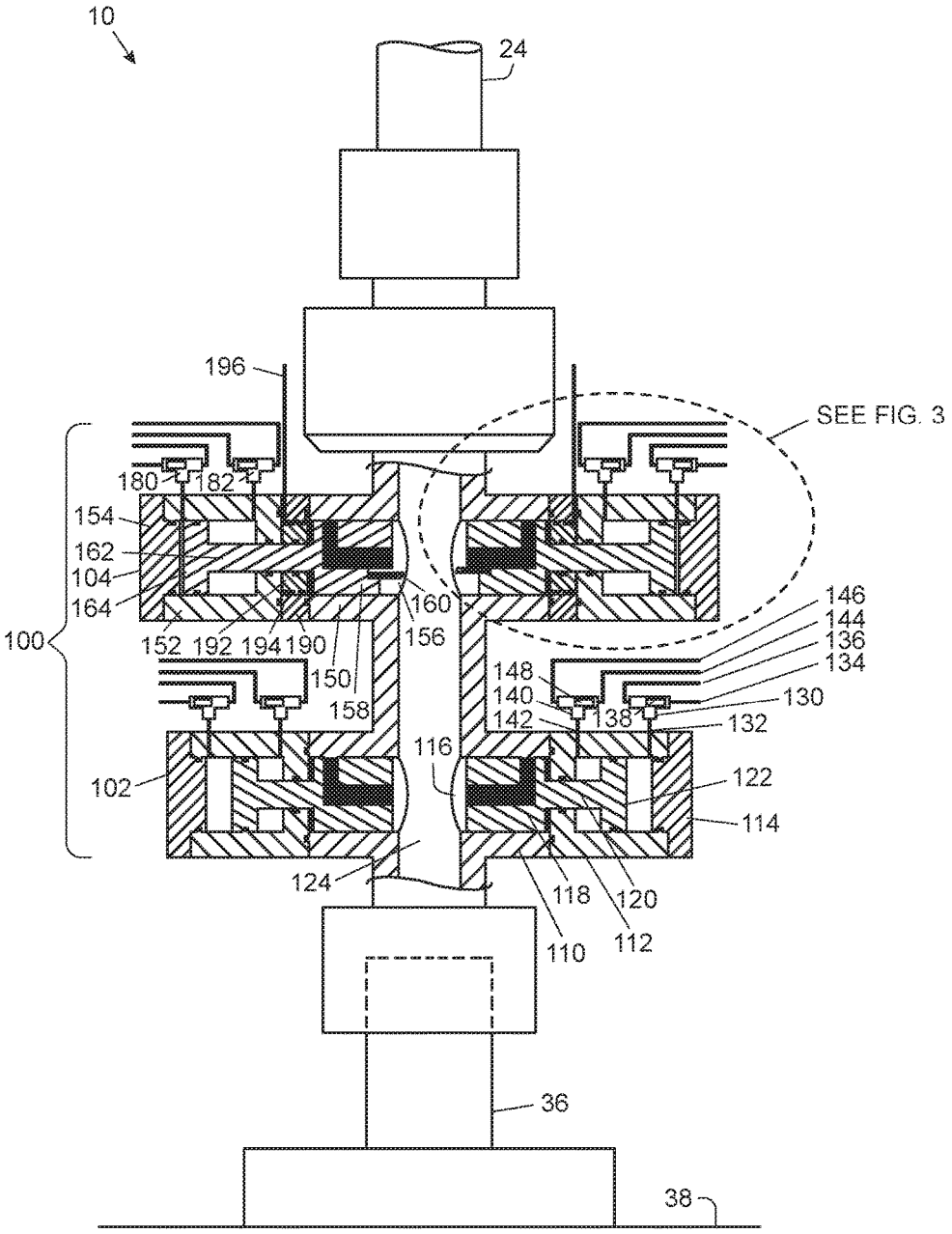
FIG. 2 is generally a half section of a BOP stack showing a conventional control system on the lower ram cavity and the control system of a preferred embodiment of the invention in the upper ram cavity.

Referring now to FIG. 2, blowout preventer stack 100 generally represents the combination of the lower marine riser package 32 or the lower blowout preventer stack 34 of FIG. 1. Conventional blowout preventer 102 is shown as a conventional ram type blowout preventer and blowout preventer 104 is shown as a ram blowout preventer with the features of this invention.

Conventional blowout preventer 102 has a body 110, and bonnets 112, end bulkheads 114, ram cavities 116, sealing rams 118, piston rods 120, pistons 122 and a central bore 124. As both ram cavities 116 of the blowout preventer 102 are the same, they will be discussed as one item. Shuttle valves 130 show an outlet connection in communication to the bonnets 112 at port 132 such that fluid flow through shuttle valves 130 will tend to urge pistons 122, piston rods 120 and sealing rams 118 towards the central bore 124. Inlets 134 to shuttle valves 130 come from the blue control pod (not shown) and inlets 136 to shuttle valves 130 come from the yellow control pod (not shown). Shuttles 138 are within shuttle valves 130 with the purpose of "shuttling" back and forth to block fluid loss out the inlet, which is not currently being supplied. Similarly, shuttle valves 140 show an outlet connection in communication to the bonnets 112 at port 142 such that fluid flow through shuttle valves 140 will tend to urge pistons 122, piston rods 120 and sealing rams 118 away from the central bore 124. Inlets 144 to shuttle valves 140 come from the blue control pod (not shown) and inlets 146 to shuttle valves 140 come from the yellow control pod (not shown). Shuttles 148 are within shuttle valves 140 with the purpose of "shuttling" back and forth to block fluid loss out the inlet, which is not currently being supplied.

Blowout preventer 104 has body 150, bonnets 152, end bulkheads 154, ram cavities 156, blind shear rams 158 with blades 160, piston rods 162, and piston heads 164. Shuttle valves 180 and 182 work similarly as shuttle valves 130 and 140 on conventional blowout preventer 102. Body sections 190 are added between body 150 and bonnets 152 to lengthen the length of ram cavities 156. Body 150, body section 190, bonnets 152, end bulkheads 154 may generally comprise a blowout preventer housing in general.

Floating pistons 192 are added within cavities 194 of body sections 190, sealingly engaging both cavities 194 and piston rods 162. Lines 196 come into the body sections 190 at a location to pump fluid between the floating piston 192 and the bonnets 152. Lines 196 provide a fluid supply from an independent source as was discussed with secondary power supply storage 96 above and on FIG. 1.

Figure 3:
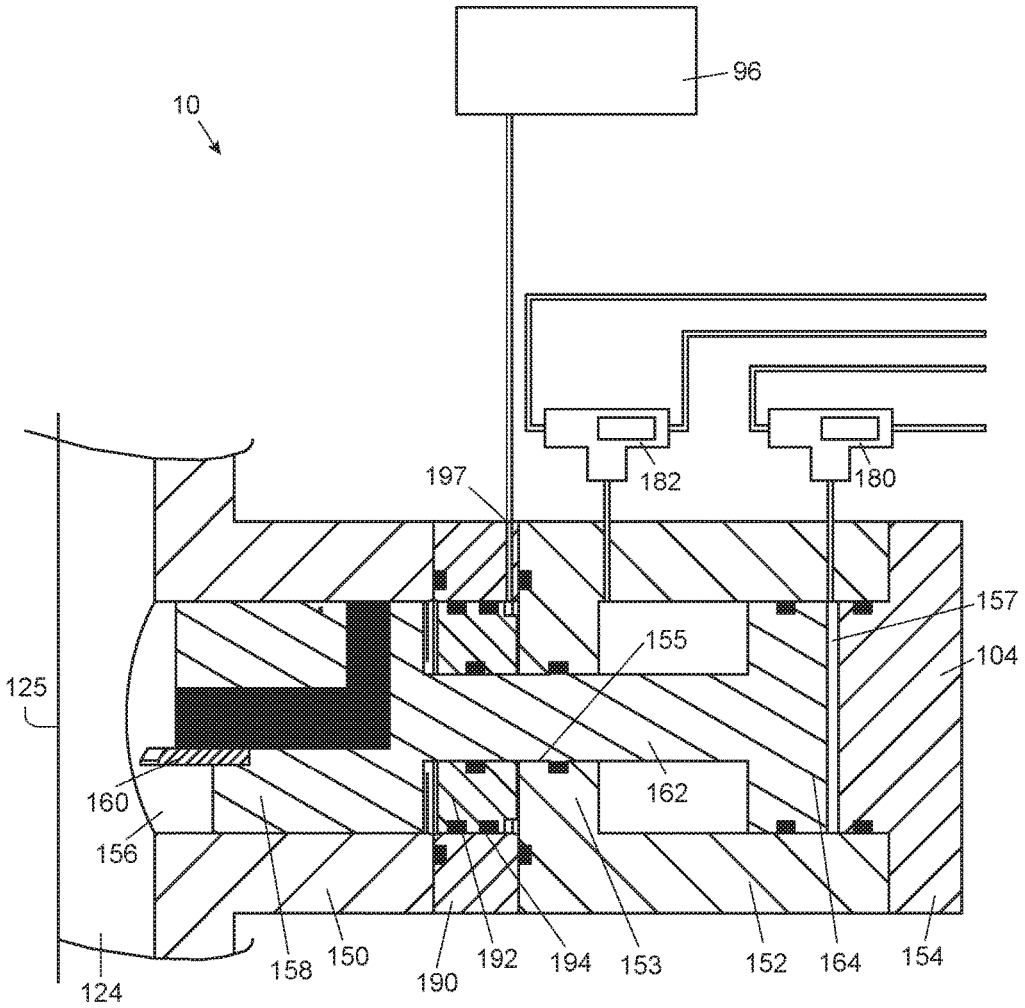
FIG. 3 is generally an enlargement of a portion of FIG. 2.

Referring now to FIG. 3, an enlargement of a portion of FIG. 2 is shown with the rams and pistons in the normal condition while drilling. It is understood that the central bore 124 may have tubing and or pipe 125 disposed therein. It is also understood that tubing and or pipe 125 may be a drill tubing such as drill pipe, well casing, tools, and so forth and the term "pipe" should not be considered to limit the invention to same. Furthermore, bonnet 152 may include end plate and or plate 153 having an aperture 155 and a cavity 157. It is understood that port 181 provides fluid to cavity 157 from primary hydraulic accumulators 94 between piston heads 164 and end bulkheads 154 and that port 183 provides fluid to cavity 157 from primary hydraulic accumulators 94 between piston heads 164 and plate 153.

Figure 4:
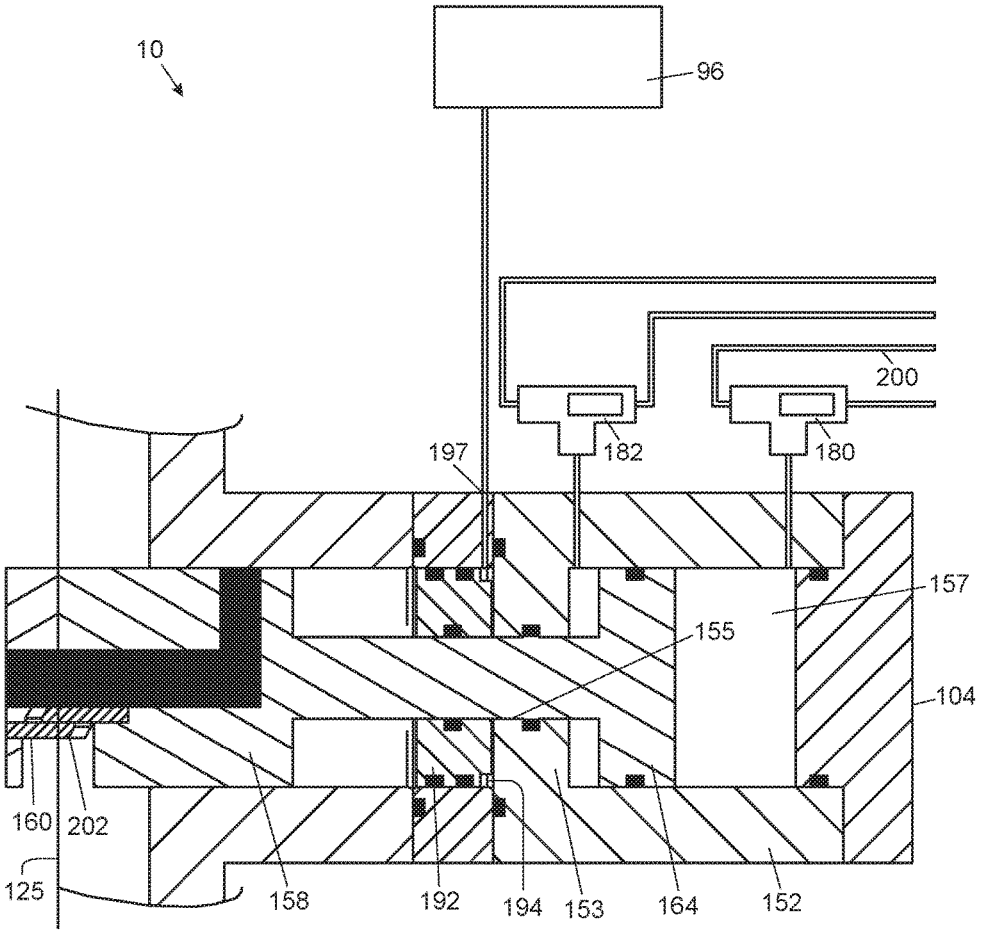
FIG. 4 is generally the same view as FIG. 3 with the BOP ram pushed forward by the conventional piston and the conventional control system.

Referring now to FIG. 4, fluid flow has been introduced into lines 200, through shuttle valves 180 into bonnets 152 to move piston heads 164, piston rods 162, and blind shear rams 158 forward until the blind shear rams 158 contact each other. Ends 202 of blades 160 have passed each other causing a shearing action to cut anything within the bore. Floating pistons 192 have remained in the original position.

Figure 5:
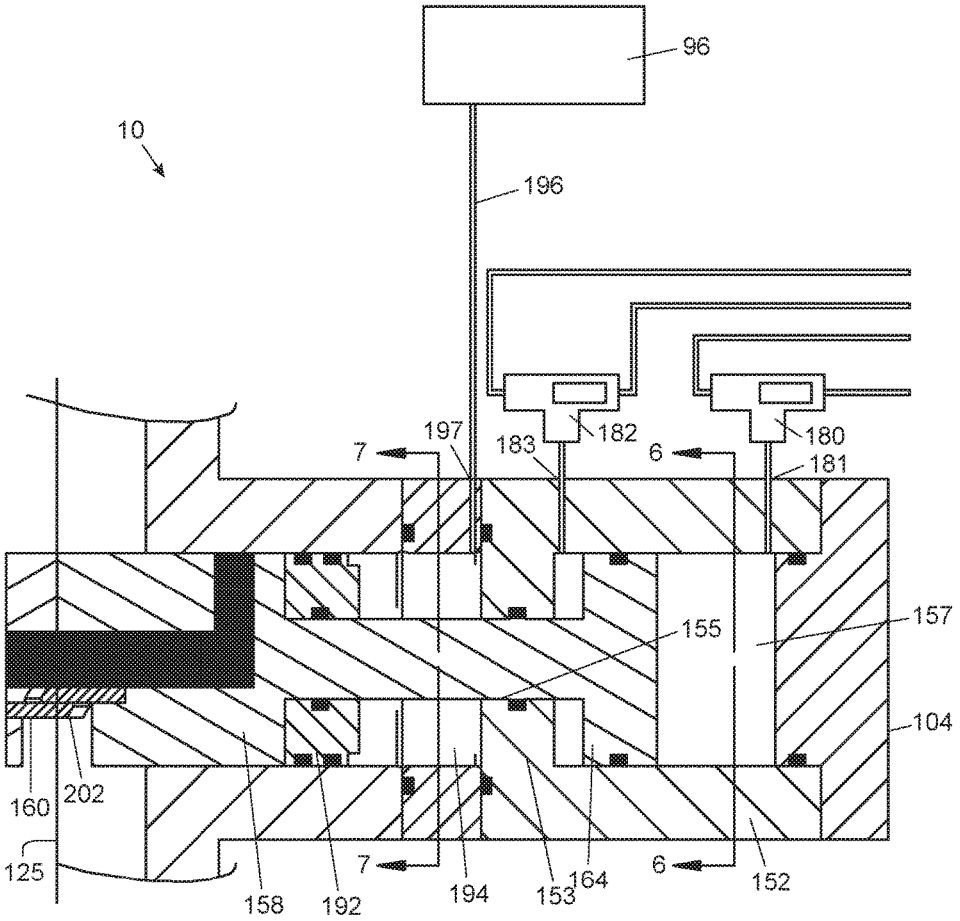
FIG. 5 is generally a similar view to FIG. 4, except the BOP ram has been pushed forward by the piston in accordance with a preferred embodiment of the invention.

Referring now to FIG. 5, the drawing presumes the blue pod and the yellow pod control systems have failed, and independent backup operation is required. Secondary power supply storage 96 has been used to send power fluid down lines 196 via port 197 to the area behind the floating pistons 192, driving them and therefore the blind shear rams 158 forward to the cutting and sealing position, similar to position of FIG. 4. It is also understood that secondary power supply 96 could be hydraulic, pneumatic, and combinations thereof.

Figure 6:
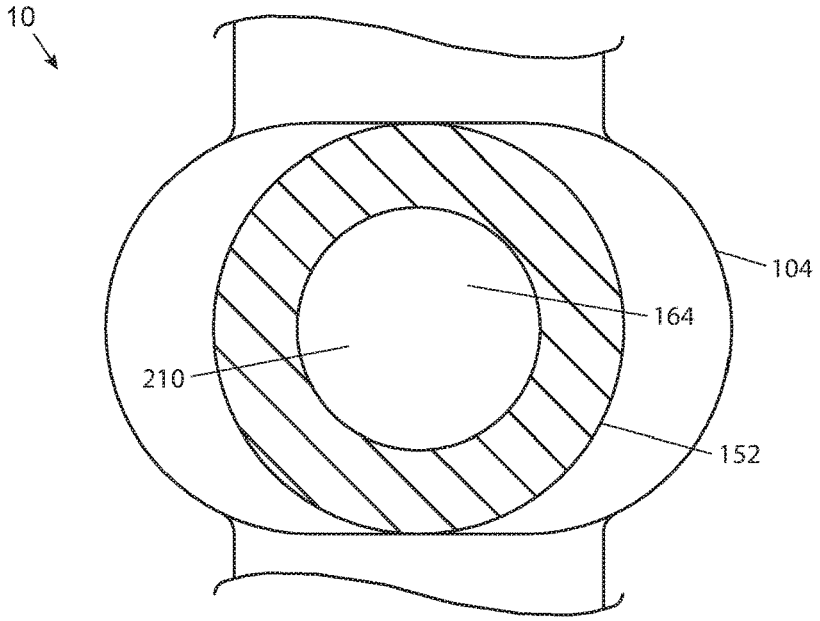
FIG. 6 is generally a section of FIG. 5 taken along lines "6-6" and generally showing the area of the conventional piston.

Referring now to FIG. 6, a section is shown through line "6-6" on FIG. 5 showing the piston area or surface 210 of piston head 164, which is generally a diameter constrained by the geometry of the bonnet 152.

Figure 7:
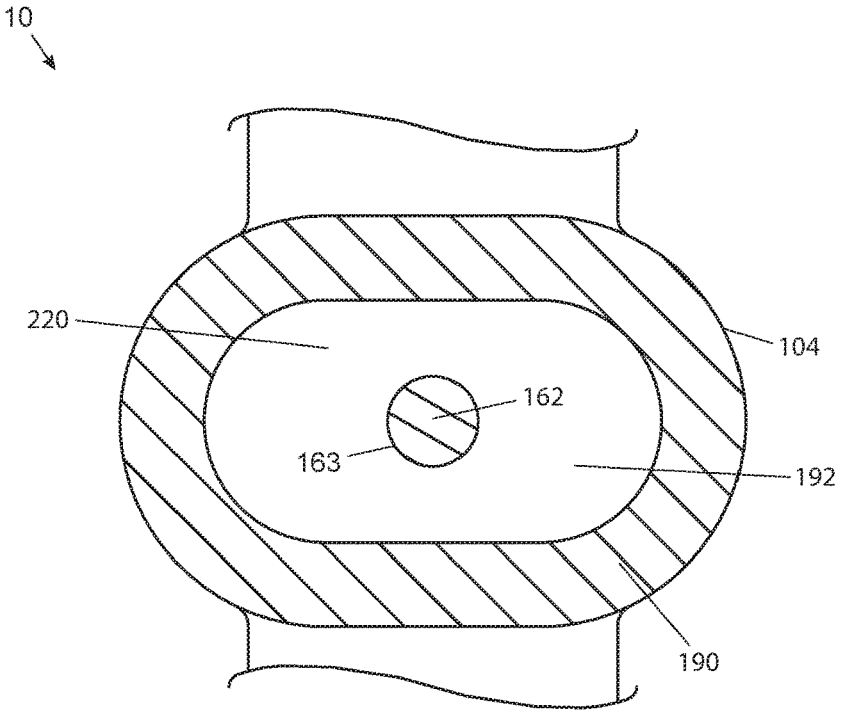
FIG. 7 is generally a section of FIG. 5 taken along view lines "7-7" and generally showing the area of the piston in accordance with a preferred embodiment of the invention.

Referring now to FIG. 7, a section is shown through line "7-7" on FIG. 5 showing the piston area or surface 220 of floating pistons 192, which may be generally an oval constrained by the geometry of the ram cavity 156. It is understood that other shapes are contemplated. As can be seen, the vertical dimension of the piston areas may be about the same, however, the horizontal extend of the piston area or surface 220 may provide a larger area for more engagement force. It is also understood that floating piston 192 may have an aperture 163.

Figure 8:
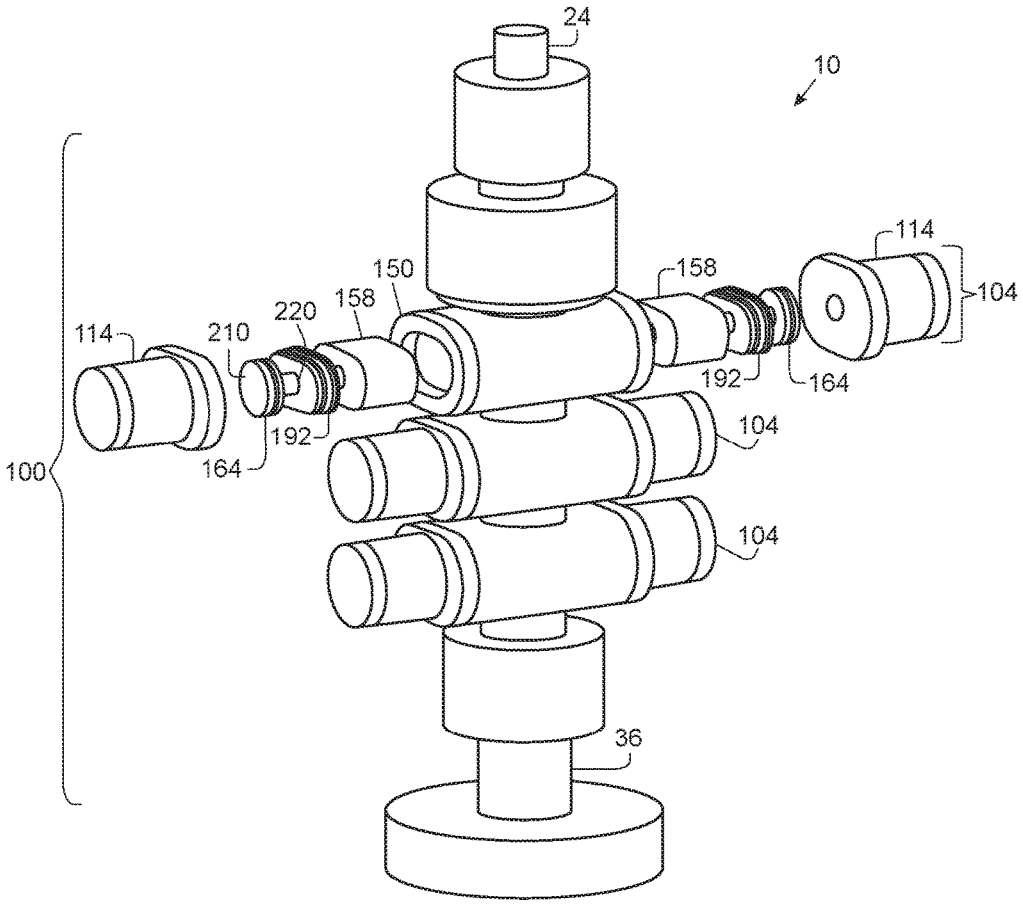
FIG. 8 is generally a partially exploded perspective view of a BOP and piston assembly without an end plate of a bonnet between floating piston and piston head and in accordance with a preferred embodiment of the invention.
Figure 9:
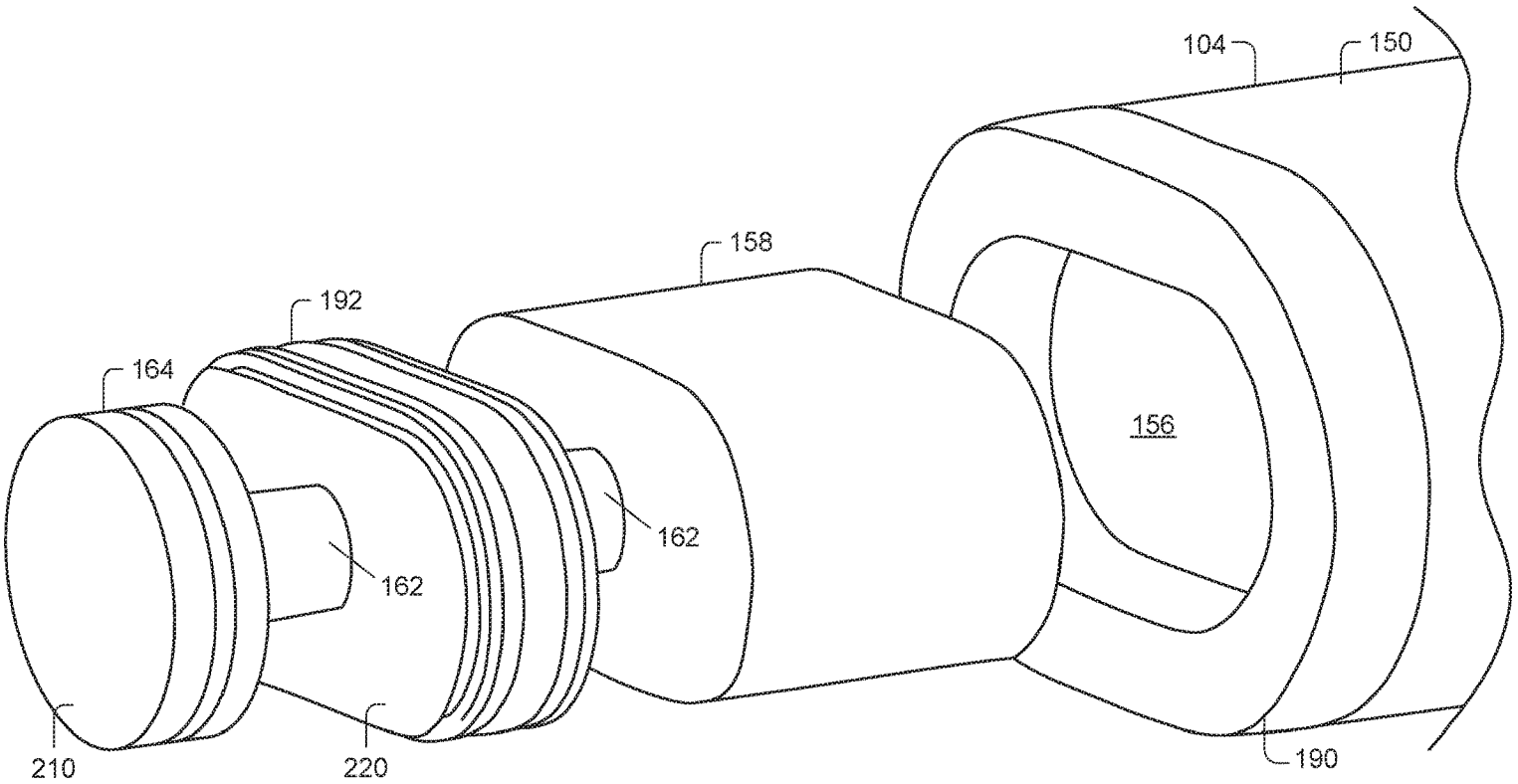
FIG. 9 is generally a partially exploded perspective view of a BOP and piston assembly of FIG. 8 in accordance with a preferred embodiment of the invention.

Referring now to FIGS. 8 and 9, it is understood that blow out preventer stack 100 may be of numerous configurations and or combinations of blowout preventer 104 and or conventional blowout preventer 102. It is also understood that numerous shapes and configurations may be utilized and piston area or surface 210 may not necessarily be round and piston area or surface 220 may not necessarily be oval.

Additionally, the blue pod and yellow pod conventional control systems are limited to 3,000 p.s.i. or 5,000 p.s.i., whereas the ram cavity working pressure is typically 10,000 p.s.i. or 15,000 p.s.i., providing the potential of 2 to 5 times more pressure force. For these reasons, not only does the independent piston in the ram cavity provide a completely independent operation, it also provides a greater force potential. Literally, in extreme risk situations, the forces from the primary and secondary sources can be combined for an even greater force.

It is, therefore, contemplated that the present invention 10 is an apparatus, system and method that may provide a power supply for engaging blowout preventer rams to secure a subsea well bore of a subsea drilling system supply, which is independent of conventional control systems, shuttle valves, seals and plumbing of conventional control system. It may comprise providing a ram cavity extension, whose inner profile may generally match inner profile of ram cavity, providing a secondary piston adapted to sealingly engage bore of said ram cavity extension and said ram cavity and adapted for sealingly engaging outer diameter of piston rod connecting conventional operating piston and the blowout preventer rams, providing said piston rod is lengthened proximately the width of said ram cavity extension, providing secondary fluid porting on distal side of said secondary piston from said bore of said subsea drilling system, and providing a secondary fluid supply into said secondary fluid porting to move said secondary piston and blowout preventer rams into an engaged position securing said subsea well bore.

It is still therefore contemplated that invention 10 may be a subsea blow out preventer comprising: a piston assembly having a blind shear ram having a first end adapted to shear well pipe and a second end; a connecting rod having a first end attached to second end of said blind shear ram, a length, and a second end; a piston head having a first end attached to said second end of said connecting rod and a second end; a floating piston having a first side adapted to selectively contact with said second end of said blind shear ram, a second side having a surface area, an aperture from said first side to said second side and wherein said aperture is adapted to slidably position said length of said connecting rod there through; a blowout preventer housing having a first end adapted to communicate with said well pipe; a length having an interior adapted to house said piston assembly wherein said length has a first cavity adapted to slidably position said blind shear ram and said floating piston and a second cavity adapted to slidably position said piston head; a plate dividing said first cavity and said second cavity, said plate having a first side, a second side, and an aperture from said first side to said second side and wherein said aperture is adapted to slidably position said length of said connecting rod there through; a second end; a first port in communication with said first section of said interior and located between said plate said first side and said floating piston said second side; a second port in communication with said second section of said interior and located between said piston head said second end and said blowout preventer said second end; a secondary power supply storage source in communication with said first port for selectively supplying fluid for slidably moving said piston assembly via said floating piston; and a primary hydraulic accumulator power source in communication with said second port for selectively supplying fluid for slidably moving said piston assembly via said piston head.

It is also contemplated that invention 10 may utilize a secondary power source 96 such as but not limited to conventional accumulators, pyro-accumulators, combinations thereof and so forth. Invention 10 may be utilized in addition to the prior art and is not necessarily mutually exclusive. It is also contemplated invention 10 may have capability integral with the blow out preventer instead of an adder. It is also contemplated that control may be a separate deep sea accumulator, explosive single charge actuator and may use independent acoustic, dead man signal, ROV, AUV, and combinations thereof.

Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed is:

1. A subsea blow out preventer comprising:

a piston assembly having:

a blind shear ram having a first end adapted to shear well pipe and a second end;

a connecting rod having a first end attached to second end of said blind shear ram, a length, and a second end;

a piston head having a first end attached to said second end of said connecting rod and a second end;

a floating piston having a first side adapted to selectively contact with said second end of said blind shear ram, a second side having a surface area, an aperture from said first side to said second side and wherein said aperture is adapted to slidably position said length of said connecting rod there through;

a blowout preventer housing having:

a first end adapted to communicate with said well pipe;

a length having an interior adapted to house said piston assembly wherein said length has a first cavity adapted to slidably position said blind shear ram and said floating piston and a second cavity adapted to slidably position said piston head;

a plate dividing said first cavity and said second cavity, said plate having a first side, a second side, and an aperture from said first side to said second side and wherein said aperture is adapted to slidably position said length of said connecting rod there through;

a second end;

a first port in communication with said first section of said interior and located between said plate said first side and said floating piston said second side;

a second port in communication with said second section of said interior and located between said piston head said second end and said blowout preventer said second end;

a secondary power supply storage source in communication with said first port for selectively supplying fluid for slidably moving said piston assembly via said floating piston; and a primary hydraulic accumulator power source in communication with said second port for selectively supplying fluid for slidably moving said piston assembly via said piston head.

* * * * *